United States Patent [19]

Walker

[11] Patent Number: 4,473,023

[45] Date of Patent: Sep. 25, 1984

[54] RELATING TO WINGSAIL CRAFT AND WINGSAILS THEREFOR

[75] Inventor: John G. Walker, Hamble, England

[73] Assignee: Walker Wingsail Systems Limited, London, England

[21] Appl. No.: 410,553

[22] Filed: Aug. 23, 1982

[51] Int. Cl.[3] ..... B63H 9/10

[52] U.S. Cl. ..... 114/103; 114/39; 114/124; 114/102

[58] Field of Search ..... 114/39, 102, 103, 167, 114/124, 104, 105, 122

[56] References Cited

U.S. PATENT DOCUMENTS

| | | | |
|---|---|---|---|
| 521,388 | 6/1894 | Pool | 114/39 |
| 1,348,912 | 8/1920 | Ward | 114/39 |
| 2,170,914 | 8/1939 | Rummler | 114/39 |
| 2,319,999 | 5/1943 | Jennings | 114/39 |
| 2,484,687 | 10/1949 | Carl, Jr. | 114/39 |
| 2,813,689 | 11/1957 | Norton et al. | 114/167 |
| 3,580,203 | 5/1971 | Martin | 114/39 |
| 3,934,533 | 1/1976 | Wainwright | 114/39 |
| 4,047,493 | 9/1977 | Menegus | 114/39 |

FOREIGN PATENT DOCUMENTS

| | | | |
|---|---|---|---|
| 318762 | 2/1920 | Fed. Rep. of Germany | 114/39 |
| 90247 | 9/1937 | Iceland | 114/39 |

*Primary Examiner*—Trygve M. Blix

*Assistant Examiner*—Patrick W. Young

*Attorney, Agent, or Firm*—Oblon, Fisher, Spivak, McClelland & Maier

[57] ABSTRACT

A wingsail assembly in which the pivoting mounting is situated in line with a strengthened portion of the sail assembly such as a strengthened leading edge of a sail element while still retaining the alignment of the axis of pivoting and the center of pressure. A sail assembly is also described in which a locating mechanism, typically in the form of wire stays, a mechanical linkage or a hydraulic system, is arranged to act on opposite sides of a balancing mass, carried by a boom attached to the wingsail assembly and arranged to locate the mass in an approximately horizontal plane. Where the wing or wing section is constructed from spars and ribs where the latter define the aerofoil section of the wing and lie in the direction of air flow, the ribs are conveniently formed from moulded GRP material and include flanges which in selected regions of the periphery of the rib subtend an angle of greater than 90° to the plane of the rib to facilitate removal of the rib from a mould and include other regions in which the flange subtends an angle of 90° to the plane of the rib to facilitate its fixing to a spar. The non 90° angles are conveniently commensurate with the angle of rake of the edge regions of the sail or sail element and are situated at points adjacent the leading or trailing edges of the sail or sail element.

6 Claims, 14 Drawing Figures

RELATING TO WINGSAIL CRAFT AND WINGSAILS THEREFOR

FIELD OF INVENTION

This invention concerns wingsail craft and particularly the mounting, construction and balancing of wingsails.

BACKGROUND OF THE INVENTION

It is known to construct a craft, typically a ship, having a so called wingsail in which the sail is formed as a more or less rigid aerofoil section as in an aircraft wing. In such arrangements it is usual to mount the sail on the vessel about an approximately vertical pivot axis. This pivot axis normally comprises a single lower bearing about which the wingsail is rotated in order to adjust the trim angle of the sail to the wind.

In both servomechanically rotated and tail trimmed wingsails, it is desirable to minimize the trimming work needed. For this reason the axis of the trim bearing is usually arranged to pass through the narrow zone in which the center of pressure of the sail is found in the normal working range. However, for most cambered and high thrust sections this zone will lie approximately 35% back from the leading edge, while even in symmetrical sections it will be some 25% back from the leading edge. Its vertical position is approximately at the half height for wingsails of rectilinear design, while simple geometrical constructions are commonly used to locate the zone vertically for wingsails of tapered or elliptical shape.

The strongest part of the wingsail, most suitable for mating with the vertical bearing assembly, is usually a Dbox leading edge section, which may occupy only the leading 20% perhaps of the total wingsail chord.

In the case of a wingsail having two elements, it is normally assumed that the leading element is the principle strength member.

Many wingsail propulsion sets need to be carefully balanced about their vertical or near vertical axes of rotation to enable optimum control of angle of attack to be achieved, and the invention is in part concerned with wingsail balancing.

In complex wingsails, composed of two or more elements hinged or otherwise connected, three distinct types of conformation may be obtained:

These are:

Symmetrical and all-in-line,

Cambered for port tack sailing, and

Cambered for starboard tack sailing.

Such a sailset may be balanced about a vertical or near vertical axis by a mass mounted on a boom and pivoted to the leading edge of the leading sailset section.

The actual construction of a wingsail or the various elements of a multiple element wingsail is important, in that weight and strength are of primary importance. The invention is therefore also concerned with the actual construction of a wingsail and of the elements which make up a multiple element wingsail.

SUMMARY OF THE INVENTION

According to one aspect of the present invention in a wingsail of symmetrical single element design having a region of principle strength (typically its leading edge) or in a wingsail having two or more elements in which one of the elements includes a region of principal strength, the bearing axis is arranged to pass through the center of pressure zone and the shape and/or configuration and/or the angle of rake of the wingsail is selected so as to bring the region of principal strength directly over the bearing assembly by which the wingsail is mounted in the craft, so that the sail is attached to the bearing assembly at its point of maximum strength.

Using this aspect of the invention ensures a strong and reliable mounting for the wingsail.

According to another aspect of the present invention in a wingsail propelled craft in which a balancing mass is mounted on a boom attached to the wingsail assembly locating means is provided, acting on opposite sides of the balancing mass, to locate the latter in an approximately horizontal plane.

The locating means may comprise a pair of wire stays, a mechanical linkage using a pushpull rod, or hydraulic means or the like, in which the final balance position is assured by a fixed or manually adjustable ratio system. Where a computer is incorporated the latter may be supplied with information relating to the sailing conditions and the craft to allow the computer to compute the optimum balance position.

According to a further aspect of the invention in a wing, particularly a wingsail for wind ship propulsion, which is constructed in a conventional manner using spars and ribs which latter define the aerofoil section, and lie broadly in the direction of air flow, the ribs are constructed from moulded glass reinforced plastics (GRP) material.

Preferably each rib includes at least one side flange which subtends over part of its length an angle which is greater than 90° to the remainder of the rib, to facilitate the removal of the rib from mould, and the angle and said part of the rib, are selected so that the flange angle corresponds to the angle of the rake of the edge of the sail with which it is to co-operate.

Preferably the flange angle reduces to 90° where it is to be attached to a spar or the like.

BRIEF DESCRIPTION OF THE DRAWINGS

The invention will now be described by way of example with reference to the accompanying drawings in which.

DETAILED DESCRIPTION OF THE PREFERRED EMBODIMENTS

Figure 1:
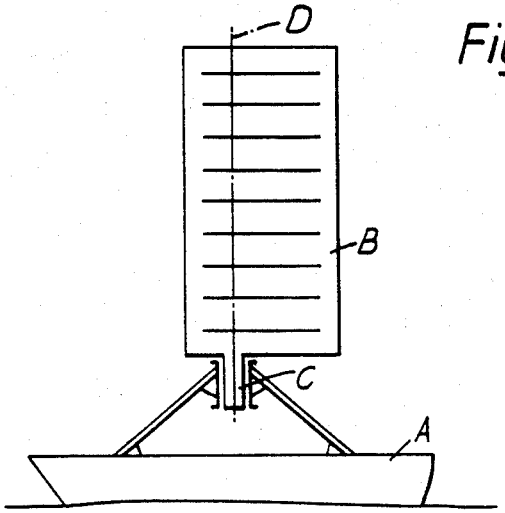
FIG. 1 illustrates a wingsail craft.

FIG. 1 shows a sailing craft hull having a wingsail B pivotally mounted in a bearing assembly C for rotation about an axis D.

Figure 2:
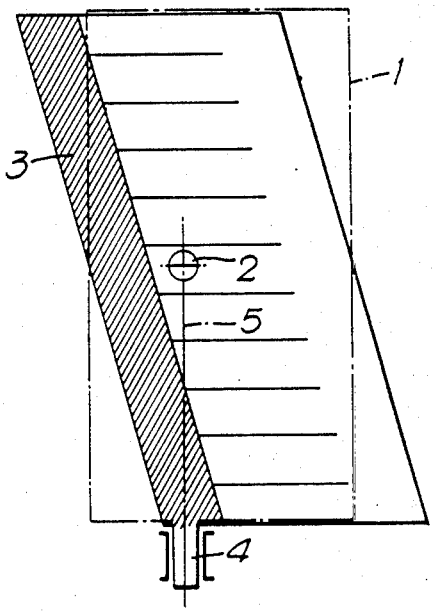
FIGS. 2 and 3 illustrate wingsail constructions embodying the first aspect of the invention.

In FIG. 2, two wingsail assemblies have been shown superimposed, both having the same center of pressure zone 2, in which one has been drawn in chain dotted outline as a simple rectangle, and the outer in solid outline as a parallelogram. The two sail assemblies have the same height, area and center of pressure position.

The strong leading edge member, 3, shown cross hatched, is arranged, by correct choice of forward sweep angle, so that its lower end is located exactly over the position of the bearing assembly 4, whilst the axis 5 of the bearing 4 still passes through the center of pressure zone 2. The strong leading edge member is provided with a flange or other arrangement to mate with the shaft or other rotating element of the bearing assembly.

Figure 3:
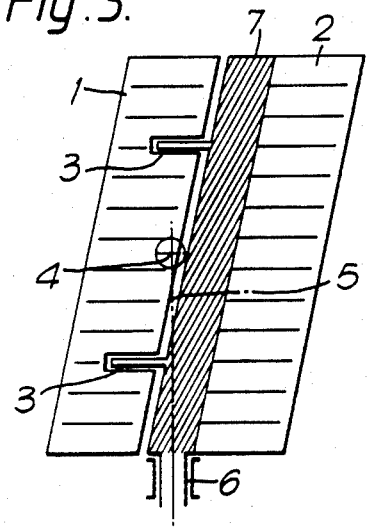

In wingsails of multielement design, it may be preferred that the second or other element of the aerofoil section shall contain the strong spar member. FIG. 3 shows a double element of such a wingsail configuration. Here the leading element 1 is hinged to the trailing main strength element 2 by hinge assemblies 3. The center of pressure zone of this complex assembly is at 4, and as before, to minimize trimming work, the approximately vertical axis 5 of the bearing 6 is arranged to pass through this zone.

In this case, the main strength member of the wingsail is the leading edge 7 of the trailing element 2 shown cross hatched. This is now arranged so that its lower end falls into the best relationship for strong and reliable mating of the bearing assembly by raking the entire assembly aft as shown.

The design is arrived at by starting with the rectilinear design, positioning the center of pressure zone on the bearing axis and then replacing the rectangle with a parallelogram of the same height and area, whose angle brings the base of the main spar conveniently over the bearing.

While this aspect of the invention has been described for simplicity with reference to parallel, constant chord wingsails, it is nonetheless applicable to wingsails of tapering or curvilinear outline.

Figure 4:
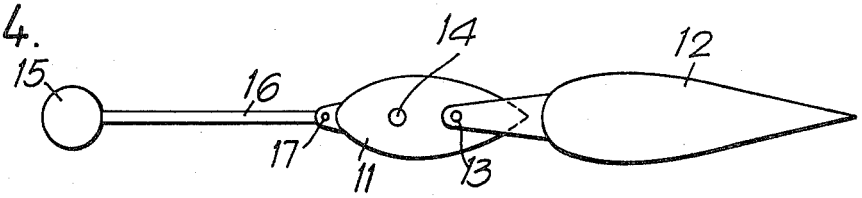
FIGS. 4, 5 and 6 illustrate a twin element sailset in the three different modes.
Figure 5:
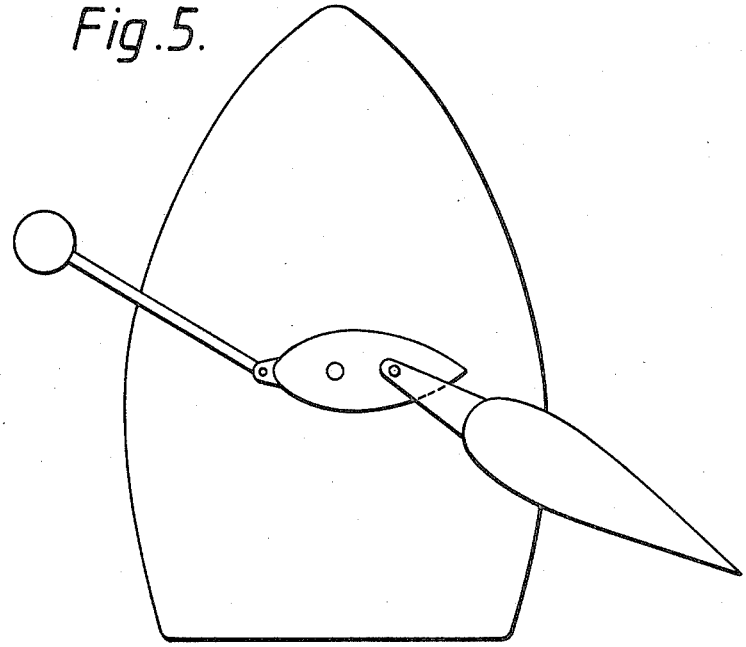
Figure 6:
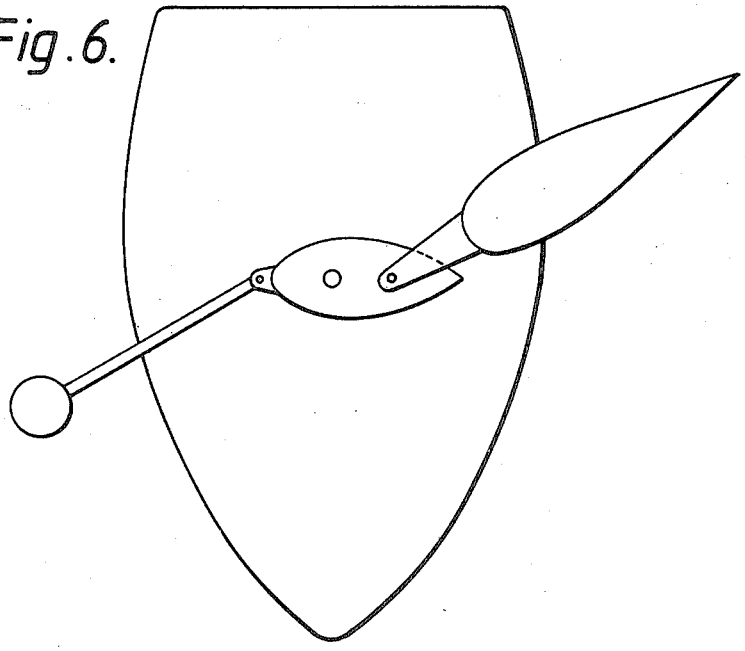

FIGS. 4,5 and 6 show a twin section sailset where 11 is the leading sail section and 12 is the trailing section, hinged to leading sail section 11 along an axis 13. The whole sailset is mounted to the vessel in this case via element 11 on a vertical or near vertical axis 14, about which the sail is trimmed to the wind.

In the all in line case, the sailset is balanced about the axis 14 by a mass 15 mounted on a boom 16 pivoted to the leading edge of the leading section 11 at a pivot 17.

In the port tack sailing case, illustrated in FIG. 5 it will be seen that a new balance may be acheived by moving the weight around in a clockwise manner until equilibrium is restored.

FIG. 6 shows the opposite tack case.

Figure 7:
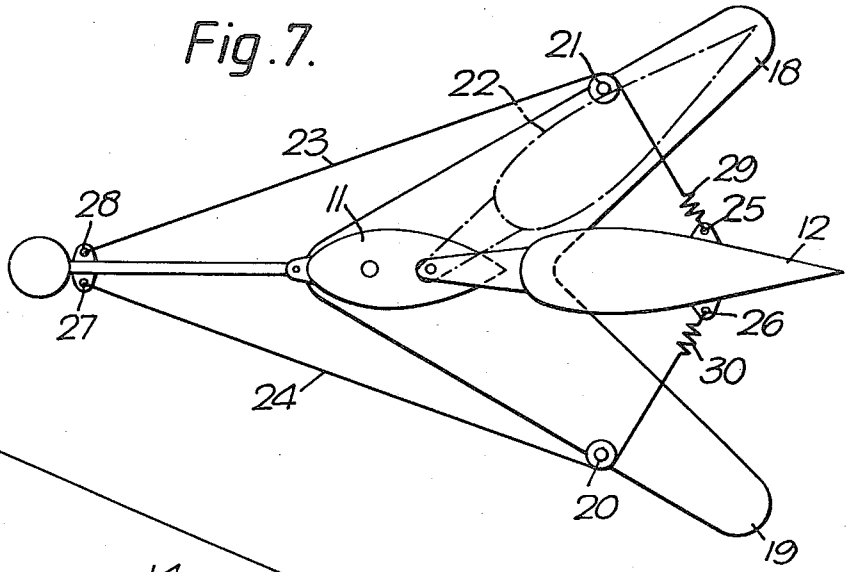
FIGS. 7 and 8 illustrate locating means according to the second aspect of the invention applied to such a sailset.

In accordance with the second aspect of the invention the location of the balance weight in an approximately horizontal plane is acheived by a pair of wire stays, as shown in FIG. 7.

To this end a streamlined structure having two fins 18, 19 is rigidly fixed to the base of the leading section 11 of the sailset. A pair of pulleys 20, 21 are carried by the fins around which wires 23 and 24 pass. The wires are connected to the trailing section 12 at lugs 25, 26 and to the counterweight boom at lugs 27 and 28. Spring elements 29, 30 in the wires maintain wire tension. Dotted lines 22 show the trailing section 12 fully deflected.

When the trailing section 12 is moved relative to 11 in order to develop camber, say in the clockwise direction in the plan view drawn, wire 23 pulls the counterweight to the correct position to maintain balance. In this case wire 24 maintains tension. The opposite action will occur upon counterclockwise rotation.

Figure 8:
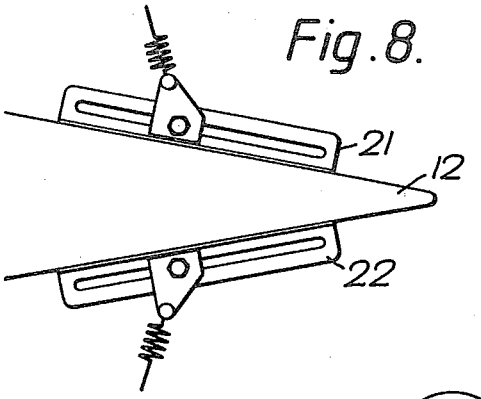

FIG. 8 shows alternative versions of the lugs 25, 26. The alternative lugs shown at 31 and 32 are slotted to allow fine adjustment of the balancing effect.

Figure 9:
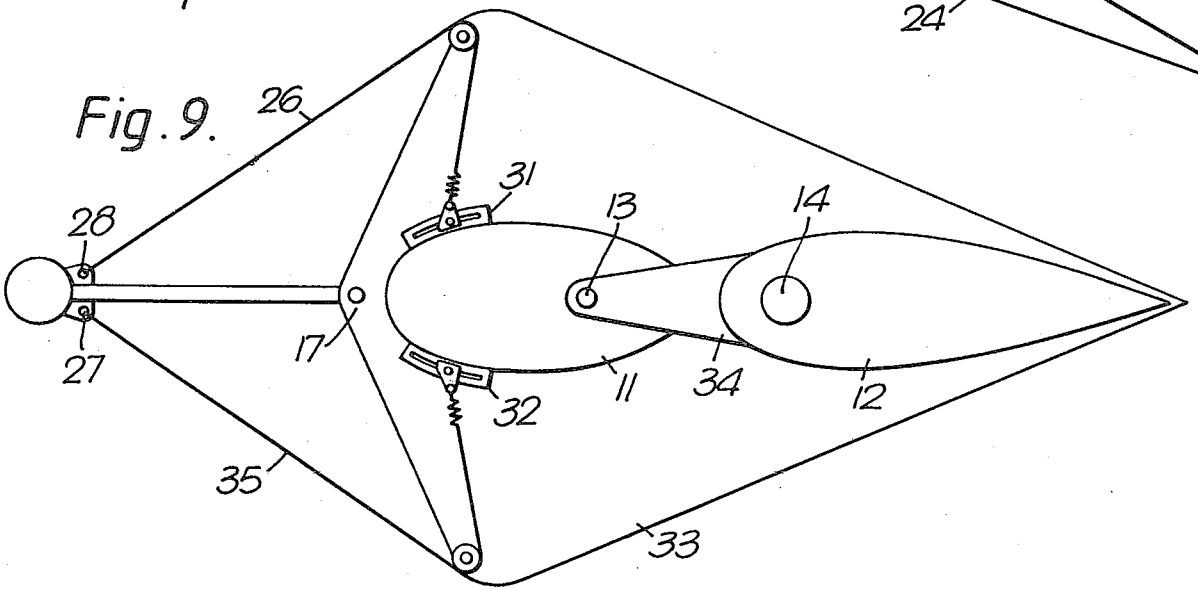
FIG. 9 illustrates this aspect of the invention applied to a sailset in which the leading sailset section is hinged to the trailing sailset section.

In some wingsail designs the trailing section 22 is mounted on the vessel via the axis 14, and the leading section 11 is then hinged to the trailing section 12. FIG. 9 shows such a case. Here an end plate structure 23 broadly similar in principle to the structure 18, 19 of FIG. 7 carries the counterweight boom pivot 17.

The pivot 13 between sections 11 and 12 could also be mounted on end plate structure 33, but for reasons of bending moment optimization is more likely to be mounted on separate hinge arms 34, working through clearance slots in 11. Wires 35 and 36 are now connected at one end via lugs 27, 28 to the counterweight boom and at the other end to adjustable lugs 31, 32 on the leading section 11. The wires adjust the position of the counterweight to maintain balance.

While bracing wires such as 23, 24 and 35, 36 are illustrated, the same action of broadly horizontal movement of the counterweight may also be achieved by:

a mechainical linkage using a pushpull rod, or hydraulic or other means in which the correct final balance may be assured either by a fixed or manually adjustable ratio system.

Figure 10:
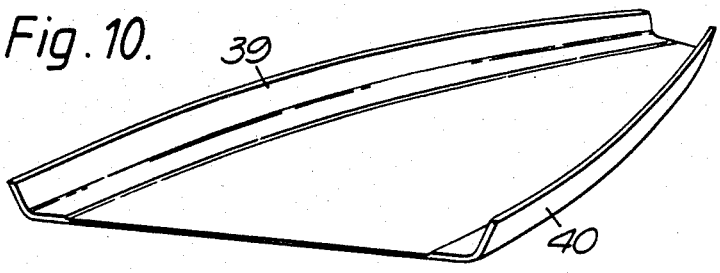
FIG. 10 is a perspective view of an open tray section the sides of which form the flanges of a rib, for a wingsail.
Figure 11:
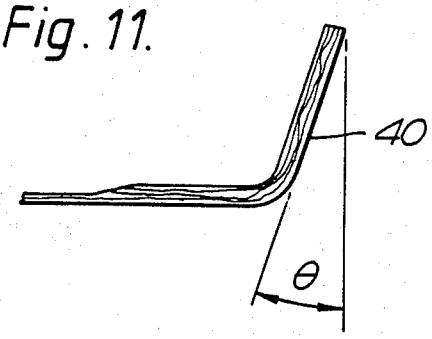
FIG. 11 is a detail of the side of the rib, of FIG. 10, FIGS. 12 and 13 show parallelogram shaped wings employing the third aspect of the invention.

FIG. 10 shows a simple form of moulding envisaged by the third aspect of the invention, in the form of an open tray section where the sides 39, 40 of the tray form the flanges of the rib. For ease of release from a simple one piece mould, such mouldings should preferably be arranged with a draft angle greater than $\theta$ as shown in FIG. 11. Such an angle can make the fixing of the skin of the aerofoil to the rib difficult to achieve. However, if the wing is parallelogram shaped, as shown in FIGS. 12 and 13 the draft angle may be utilized.

Figure 12:
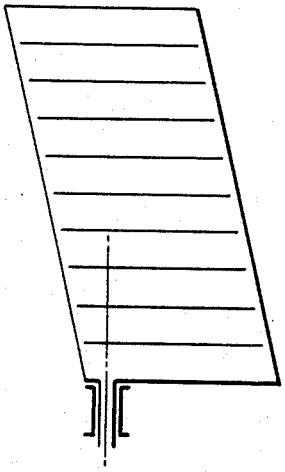
Figure 13:
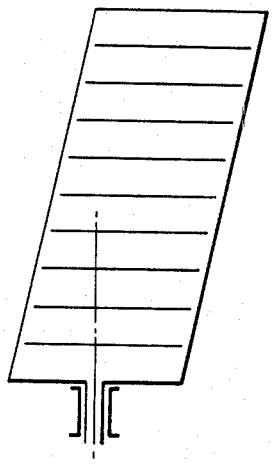
Figure 14:
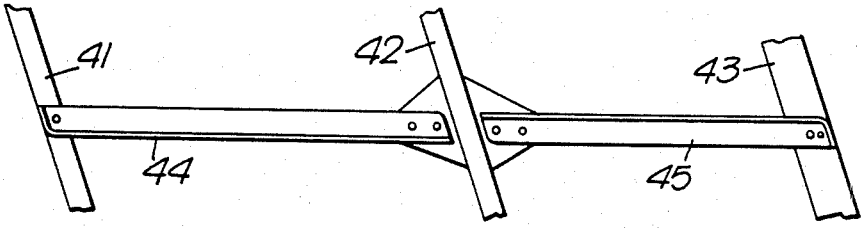
FIG. 14 is a cross section on the center of a forwardly raked sail element, employing this aspect of the invention.

FIG. 14 is a center line section through a raked forward sail element such as is shown in FIG. 12 where a leading edge member 41, a main spar 42 and a trailing edge 43 are connected by a typical leading edge rib 44 and a typical trailing edge rib 45.

It will be noted that, because this is swept forward design, the leading edge rib 44 is fitted with its flanges upwards, while the trailing edge rib 45 is fitted with its flanges downwards. The draft angle of the mould is made equal to the desired forward rake angle at leading edge and trailing edge, but is gradually reduced to zero so that the flange of each rib is at 90° to the web in the immediate vincinity of the main spar 42.

By varying the draft angle in this way along each rib the rib flanges will in general be coplanar with the skin for ease of skin attachment, whilst the mould and moulding techniques are kept simple and reliable.

In the case of raked back wingsails, as in FIG. 13, then the leading edge rib elements will be fitted flange down and the trailing edge ribs will be fitted flange up.

In the case of multielement wings, where each element has its own broadly aerofoil shaped section and main spar, the ribs will be fitted as described above in each individual element, as if it were a complete wing.

I claim:

1. A wingsail assembly, comprising:

at least a first and second wingsail, said first sail being mounted for rotation about a first generally vertical axis, and said second sail being mounted on said first sail for rotation about a second generally vertical axis spaced from said first axis;

means interconnecting said second sail with said first sail;

a boom supported on said first sail;

a balancing mass mounted at a remote end of said boom; and control means disposed on opposite sides of said boom for moving said balancing mass in an approximately horizontal plane as said first and second sails move about their respective axis such that said balancing mass balances said wingsail assembly.

2. A wingsail assembly as claimed in claim 1, wherein one of said first and second sails has a region of principal strength extending between a bottom and top portion of said one sail and further comprising a bearing at said bottom portion of said one sail by means of which said sail can be mounted in a craft, said bearing also defining an axis of pivoting of said one sail and wherein the axis of pivoting of said one sail passes through a zone in which a centre ofpressure of said one sail normally lies and through said region of principal strength and wherein said region of principal strength extends to said bearing.

3. A wingsail assembly as claimed in claim 1, wherein said control means further comprises a wire stay disposed on each side of said assembly and extending laterally from said boom, around a fixed point on said assembly, and back to one of said first and second sails such that when said sails move about their respective axis, said balancing mass on said boom also moves to balance said assembly.

4. A wingsail assembly as claimed in claim 1, wherein said control means further comprises a wire stay disposed on each side of said assembly and extending laterally from said balancing mass, around a fixed point on said assembly, and back to one of said first and second sails such that when said sails move about their respective axis, said balancing mass on said boom also moves to balance said assembly.

5. A sailing vessel, comprising a craft;

at least a first and second wingsail, said first sail being mounted for rotation about a first generally vertical axis, and said second sail being mounted on said first sail for rotation about a second generally vertical axis spaced from said first axis;

means interconnecting said second sail with said first sail;

a boom supported on said first sail;

a balancing mass mounted at a remote end of said boom; and control means disposed on opposite sides of said boom for moving said balancing mass in an approximately horizontal plane as said first and second sails move about their respective axis such that said balancing mass balances said wingsail assembly;

one of said first and second sails having a region of principal strength extending between the bottom and top portion of said one sail and further comprising a bearing at said bottom portion of said one sail by means of which said one sail is mounted in said craft, said bearing also defining an axis of pivoting of said one sail wherein the axis of pivoting of said one sail passes through a zone in which a centre of pressure of said one normally lies and through said region of principal strength and wherein said region of principal strength extends to said bearing.

6. A sailing vessel, comprising;

a craft;

at least a first and second wingsail, said first sail being mounted for rotation about a first generally vertical axis, and said second sail being mounted on said first sail for rotation about a second generally vertical axis spaced from said first axis;

means interconnecting said second sail with said first sail;

a boom supported on said first sail;

a balancing mass mounted at a remote end of said boom; and control means disposed on opposite sides of said boom for moving said balancing mass in an approximately horizontal plane as said first and second sails move about their respective axis such that said balancing mass balances said wingsail assembly.

* * * * *